US005628827A

United States Patent [19]

McCollam et al.

[11] Patent Number: 5,628,827

[45] Date of Patent: May 13, 1997

[54] NON-RECIRCULATING, DIE SUPPLIED DOCTORED ROLL COATER WITH SOLVENT ADDITION

[75] Inventors: Robert P. McCollam, Roseville; Norman E. Gehrke, Browton, both of Minn.; Karl J. Warren, Hudson, Wis.; Mark D. Larson, Maplewood, Minn.; George D. Kostuch; Thomas W. Braid, both of White Bear Lake, Minn.

[73] Assignee: Minnesota Mining and Manufacturing Company, St. Paul, Minn.

[21] Appl. No.: 109,352

[22] Filed: Aug. 20, 1993

Related U.S. Application Data

[63] Continuation-in-part of Ser. No. 951,462, Sep. 25, 1992, abandoned.

[51] Int. Cl.[6] ..... B05C 11/00

[52] U.S. Cl. ..... 118/695; 118/693; 118/261

[58] Field of Search ..... 118/258, 249, 118/263, 261, 683, 693, 694, 672, 676, 677, 410, 695; 427/356, 428

[56] References Cited

U.S. PATENT DOCUMENTS

| | | | |
|---|---|---|---|
| 2,668,438 | 2/1954 | Marquardt | 73/32 |
| 2,755,669 | 7/1956 | Beard | 73/439 |
| 3,730,089 | 5/1973 | McCutcheon | 101/363 |
| 4,284,005 | 8/1981 | Weigele et al. | 101/363 |
| 4,332,840 | 6/1982 | Tamaka et al. | 427/130 |
| 4,366,754 | 1/1983 | Sarda | 101/208 |
| 4,490,418 | 12/1984 | Yoshida | 118/410 |
| 4,518,167 | 5/1985 | Dutko | 277/81 R |
| 4,534,290 | 8/1985 | Schroder et al. | 101/365 |
| 4,581,994 | 4/1986 | Wildmann | 101/363 |
| 4,675,230 | 6/1987 | Innes | 427/280 |
| 4,708,629 | 11/1987 | Kasamatsu | 425/466 |
| 4,719,799 | 1/1988 | Wicks et al. | 73/302 |
| 4,828,779 | 5/1989 | Hiraki et al. | 264/171 |
| 4,864,930 | 9/1989 | Runyan et al. | 101/365 |
| 4,871,593 | 10/1989 | McIntyre | 118/249 |
| 4,876,982 | 10/1989 | Claassen | 118/413 |
| 4,945,832 | 8/1990 | Odom | 101/350 |
| 5,318,804 | 6/1994 | Yoshida | 118/410 |

FOREIGN PATENT DOCUMENTS

| | | |
|---|---|---|
| 1428759 | 1/1966 | France . |
| 1238946 | 9/1989 | Japan . |

OTHER PUBLICATIONS

Product Literature: *Doctor Blade Features* and *We Build a Better Doctor Blade*, Harris and Bruno Machinery Company ( No Date Available).

Prodcut Literature: *Rotocoater*, Article, IR International (No Date Available).

Reprinted Article: *A Review of Coaters for High/100* Solids Use, Paper, Film & Foil Converter (Mar. 1980).

*Primary Examiner*—Brenda A. Lamb

*Attorney, Agent, or Firm*—Gary L. Griswold; Walter N. Kirn; Charles D. Levine

[57] ABSTRACT

A coater incorporates a die, a reservoir, a gravure cylinder, and a doctor blade for applying coating fluid to a moving surface. The flow rate of coating fluid to the gravure cylinder is controlled to equal the rate at which coating fluid is consumed by the coating process. This eliminates the need to recycle surplus coating fluid. The coating fluid can be quickly and conveniently replaced with a solvent in the reservoir when coating is not being performed to reduce the occurrence of coating defects arising from excessive evaporation of solvent and premature solidification of coating fluid.

29 Claims, 7 Drawing Sheets

NON-RECIRCULATING, DIE SUPPLIED DOCTORED ROLL COATER WITH SOLVENT ADDITION

CROSS REFERENCE TO RELATED APPLICATION

This is a continuation-in-part of application Ser. No. 07/951,462, filed on Sep. 25, 1992, now abandoned.

TECHNICAL FIELD

The present invention relates to roll coaters. More particularly, the present invention relates to roll coaters without fluid recycling.

BACKGROUND OF THE INVENTION

The production of composite materials by the coating of layers of fluid substances onto solid substrates and solidifying the layers by drying or curing is well known. Composite layered materials formed by such coating processes are especially useful as information recording media.

An important requirement for layers of information recording media is uniformity. Non-uniformities are defects which can lead to improper information recording or retrieval. When information recording layers are formed by coating fluids, a common source of coating non-uniformity is the presence of oversized particulates in the coating fluid. These oversized particulates result in defects in the recording layer, and can be the result of contamination from outside the system, but are more commonly dried dispersion clumps formed within the coating fluid during coating. A common source of clumps is premature solidification of portions of the coating fluid in localized areas of the coating apparatus before the coating step.

Coating fluids used to produce magnetic recording layers, called magnetic recording fluids, typically include fine particles of magnetic materials, called magnetic pigments, dispersed in a liquid binder of polymeric materials, solvents, reactants, and catalysts. The liquid binder is formulated to solidify into a matrix which binds the pigment into a durable layer suitable for magnetic recording. Combinations of catalysts and other ingredients, called activators, initiate and sustain crosslinking or polymerization reactions during solidification. The properties of the resulting magnetic recording layer may be enhanced by additives such as lubricants, plasticizers, and antistatic agents.

The solidification of magnetic coating fluids into magnetic recording layers typically occurs first by evaporation of the solvent, then by chemical curing reactions such as crosslinking or polymerization. Solvent removal is initiated by coating the fluid as a thin film, since this greatly increases the surface area available for solvent evaporation. Curing is typically completed by the application of heat over time, which accelerates solvent evaporation and increases the rates of crosslinking and polymerization. Other forms of energy, such as ultraviolet light or electron beams, can promote crosslinking or polymerization.

While open reservoir coating apparatus are especially prone to localized premature drying of the coating fluid, these apparatus have many advantages which either outweigh the drying problem or provide great incentive to find solutions to it. Two typical types of reservoirs are the pan and the trough. In the pan type reservoir, shown in FIG. 1, a receiving roller, such as a gravure cylinder 10, is immersed in a coating fluid 12 in a reservoir 14. The gravure cylinder 10 rotates and carries a layer of coating fluid to a doctor blade 16, which contacts the gravure cylinder 10 and wipes off the excess fluid, leaving the remaining fluid on the gravure cylinder 10 to be carried to a substrate 18 on which it is coated. The substrate 18 is held close to the gravure cylinder 10 by a backup roller 20.

The amount of fluid 12 carried by the gravure cylinder 10 to the substrate 18 can be governed by providing small fluid-holding pits or grooves, called cells 32, in the outer surface of the gravure cylinder 10. By applying an abundance of coating fluid 12 to the gravure cylinder 10 and then wiping off the excess fluid with the doctor blade 16, the fullness of the cells 32 is controlled. Each cell 32 acts as a measuring cup so that the rate of coating fluid 12 application is closely controlled in both the downweb and crossweb directions.

Alternatively, smooth rollers, without cells, can be used and the coating thickness is controlled with a roller or a doctor blade. The roller or doctor blade is spaced a small distance from the surface of the roller to provide an accurately controlled gap for a layer of coating fluid to be carried by the surface of the coating roller. Transfer of the coating fluid to the substrate is similar to that found in celled gravure coating. Typical examples of controlling the application of coating fluid in this manner can be found in U.S. Pat. Nos. 4,864,930; 4,581,994; and 4,534,290. Alternatively, in offset roll coating, the coating fluid first is transferred to intermediate rollers and then is transferred to the substrate. Pan type reservoirs expose a large area of fluid to the air where solvent removal occurs, causing premature fluid drying. Pan systems also typically have stagnant areas near the pan walls where fluid residence time is long, resulting in further loss of solvent.

Referring to FIG. 2, trough type systems minimize the area of fluid that contacts the air and reduces fluid residence time. A suitable fluid level is maintained in the trough 22 by supplying excess coating fluid 12 to the reservoir 15 and providing an opening 28 in the reservoir wall at the height of the desired fluid level. Coating fluid fills the trough 22 to this level and overflow through a tube 30, returning to the reservoir 15.

In this configuration, the trough 22 is supplied with coating fluid 12 by a pump 24, which feeds the fluid from a reservoir 15 through a filter 26. The coating fluid 12 supplies a gravure cylinder 10, while the surface of the gravure cylinder 10 moves downwardly past the doctor blade 16. The coating fluid is then transferred to the substrate 18 by contact between the substrate 18 and the coating fluid 12 on the gravure cylinder 10, which is maintained by a backup roller 20. The excess fluid returns to the reservoir 15. Many trough systems use a top seal 34, shown in FIG. 2, which contacts the roller so the air volume above the fluid becomes saturated with solvent. These systems work only if the fluid remaining on the gravure roller does not contaminate the top seal. Many fluids dry on the seal causing flaws. If the system is run without the top seal or with the seal close to the supply roller, the air above the pool does not become saturated with solvent and the fluid in the reservoir dries.

An area in which this is particularly likely to occur is the region above the wetting line between the wall of the reservoir and the free surface of the coating fluid. Since the level of coating fluid in the reservoir is constantly changing, thin films of fluid can form on the reservoir walls as the fluid drains, due to dynamic wetting effects. This film can sometimes dry before the fluid level rises again, due to the increased rate of solvent evaporation brought about by the high surface area to volume ratios found in thin liquid films.

When the fluid level rises and falls again, another layer of coating fluid is deposited over the first, adding to the thickness of the solid layer formed. The solidified areas can eventually break off the walls, mix with the coating fluid, and find their way onto the substrate, where they show up as flaws.

Trough type systems also typically use an overflow system which requires costly and complicated filtering of a catalyzed fluid. Overflow systems that use the top seals increase the pressure in the system and increase the likelihood of end seal leaks. A further problem caused by overflow and recirculation systems arises from the need to crosslink the polymers in the coating fluid. Since the effects of catalysts and other crosslinking agents are often cumulative over time, any eddies or areas of stagnation increase the average residence time in the fluid, thereby increasing the likelihood of premature chemical solidification. Furthermore, since clumps formed from catalyzed coating fluids often involve crosslinking or polymerization reactions, they are not likely to be redissolved by the coating fluid solvents. An additional problem which can occur is filter clogging since recirculating, clump-laden coating fluid typically passes through a filter, requiring more frequent cleaning or replacement of the filters. Eliminating overflow and recirculation reduces premature solidification by reducing fluid surface area and eliminates the need for recirculation and filtration of catalyzed fluids.

Coating apparatus which use fluid reservoirs and receiving rollers but which supply coating fluid to the reservoir without overflow and recirculation are known. A typical method for accomplishing this is to provide a fluid level sensor in the reservoir which feeds a signal back to the fluid supply source to control the rate of supply to the reservoir. U.S. Pat. No. 3,730,089 discloses a mechanical device which senses the size of the rotating vortex of ink in a printing press reservoir, thereby providing an indication of the ink level. The vortex sensor is mechanically coupled to an ink supply to provide additional ink as needed. However, this type of level sensor introduces additional surfaces on which dynamic wetting effects can occur, thereby increasing the rate of clump formation. A different ink level sensor is disclosed in U.S. Pat. No. 4,284,005 which measures the ink level in the reservoir by a capacitive device which senses the vertical location of the surface of the ink in the reservoir and sends an appropriate signal to the ink supply source. These capacitive devices are affected by nearby metal and are unreliable as it is hard to keep clean electrical connections.

Another approach to liquid depth measurement is to measure the hydrostatic pressure at the bottom of the liquid layer, such as with a bubble tube. Bubble tubes measure hydrostatic pressure in a liquid using a small tube which is connected to a pressurized supply of air or gas, called the test gas, placed in the liquid where the hydrostatic pressure is to be measured. The flow rate of the test gas is adjusted until a stream of bubbles form at the end of the tube. Measuring the gas pressure yields the hydrostatic liquid pressure, which provides an indication of the liquid level. Various types of bubble tubes and bubble tube improvements are disclosed in U.S. Pat. Nos. 2,668,438; 2,755,669; and 4,719,799. Bubble tubes and the gas supply systems needed to operate them are commercially available. A problem which sometimes arises when bubble tubes are used with solutions of solids in a volatile solvent is that premature solvent removal and solidification of the solution can occur on the surface of the tube. As bubbles exit the tube, the tube inside diameter becomes coated unless the test gas is solvent saturated. This can lead to clump formation and tube clogging.

One requirement for trough-supplied rotating rollers are reliable seals between the rotating surface of the receiving roller and the stationary reservoir. Many known end seal configurations are suitable for printing ink or other similar fluids. However, none can adequately withstand the high level of abrasiveness and exposure to solvents encountered in magnetic recording coating fluids and similar fluids. One method of sealing the ends of trough reservoirs, is disclosed in U.S. Pat. No. 4,945,832, includes sealing against the curved peripheral areas near each end of the receiving roller. The seal is made of closed cell silicone foam and provides sufficient flexibility to maintain contact with both the roller and the trough, while permitting the distance between the doctor blade and the roller to be adjusted. An additional seal contacts the end of the roller. However, when used with magnetic pigments, these seals are subject to severe wear and leakage. Additionally, wear products fall into the coating solution.

Coating apparatus which do not use reservoirs also are known. U.S. Pat. No. 4,332,840 discloses a variety of methods for dispensing coating fluid through a slot, called an extrusion bar, which extends across either the moving substrate or a receiving roller. The coating apparatus also includes additional rollers, doctor blades, or other metering devices. These devices for liquid delivery to rotating rollers involve some form of recirculation due to excess supply of the coating fluid.

During the coating process, coating must be stopped for periods of time ranging from minutes to hours. A typical cause for such stoppage might be web breaks, or malfunction of some part of the system. On such occasions, it is preferred to maintain the coating system in a standby mode, or idling state, to resume coating quickly when desired. It is also preferred to maintain the coating system in an idling state during the start of a coating run, since many adjustments and other tasks must be performed as part of setting up the coating process. However, if the coating apparatus is left idling for more than a few minutes, volatile solvents can evaporate from the reservoir, leading to excessive increases in viscosity and premature solidification of the coating fluid. This results in agglomerate formation and increased occurrence of coating defects when coating is resumed.

There is a need to provide a coating apparatus reservoir and a system for supplying coating fluid to the reservoir which reduces flaws in the coated product by reducing conditions leading to premature solidification due to solvent removal. There is a need for providing a system for sealing the ends of the reservoir to the roller which is less subject to wear and leakage than known devices. There also is a need to match the usage rate to the supply rate to the reservoir by eliminating the need for recirculation and to prevent defects from arising due to idle periods.

SUMMARY OF THE INVENTION

The present invention is an apparatus for coating a fluid onto a moving substrate. Coating fluid is supplied from a die to a reservoir to a rotating gravure cylinder. The rate of supplying fluid to the reservoir is at least equal to the rate of consumption of the coating fluid by coating onto the substrate. The hydrodynamic design of the coating fluid flow path reduces premature solidification and agglomerate formation in the reservoir. The rotating interface between the ends of the reservoir and the gravure cylinder is simply and reliably sealed.

The apparatus includes a coating die having a coating slot and an external wall along which the fluid flows after exiting through the slot. The external wall includes a spillway adjacent the coating slot opening and the coating die also includes a supply chamber which feeds fluid into the coating slot. A rotatable coating cylinder is located adjacent the coating die to coat the fluid onto the substrate. A reservoir is located between the coating die and the coating cylinder. The reservoir receives the fluid flowing along the coating die before the fluid is applied onto the coating cylinder. The reservoir includes first and second ends, a front surface formed by the external wall of the coating die, a rear surface formed by the surface of the coating cylinder, and a bottom surface formed by the doctor blade. The first and second ends are sealed against the rear surface. The doctor blade regulates the amount of liquid applied to the gravure cylinder from the reservoir. The apparatus also includes a system for measuring and controlling the depth of the fluid in the reservoir at a predetermined level.

The apparatus also includes a system which loads the doctor blade against the receiving roller. The loading system can repeatedly apply a precise force to the doctor blade to locate precisely the doctor blade relative to the receiving roller by moving the doctor blade in only a horizontal, translational direction without requiring any angled or side-to-side adjustments.

End seals seal the ends of the die and the ends of the reservoir. The end seals can be loaded to maintain the end seals in position adjacent the ends of the die to compensate for relaxation of the seals over time. Also, the end seals can each include a pad portion which seals against the doctor blade, and a wear plate portion which seals against the receiving roller. The wear plate portion prevents the pad portion from contacting and wearing against the receiving roller.

In addition, the coating fluid in the reservoir can be replaced quickly and conveniently with a suitable solvent, when coating is not being performed. This reduces the occurrence of coating defects arising from excessive evaporation of solvent and premature solidification of coating fluid.

The invention also encompasses a method for coating a fluid onto a substrate including extruding the fluid through a coating die slot, causing the fluid to flow from the die into a reservoir, applying the fluid onto a coating cylinder, and applying the fluid from the coating cylinder onto the substrate.

DETAILED DESCRIPTION OF PREFERRED EMBODIMENTS

Figure 1:
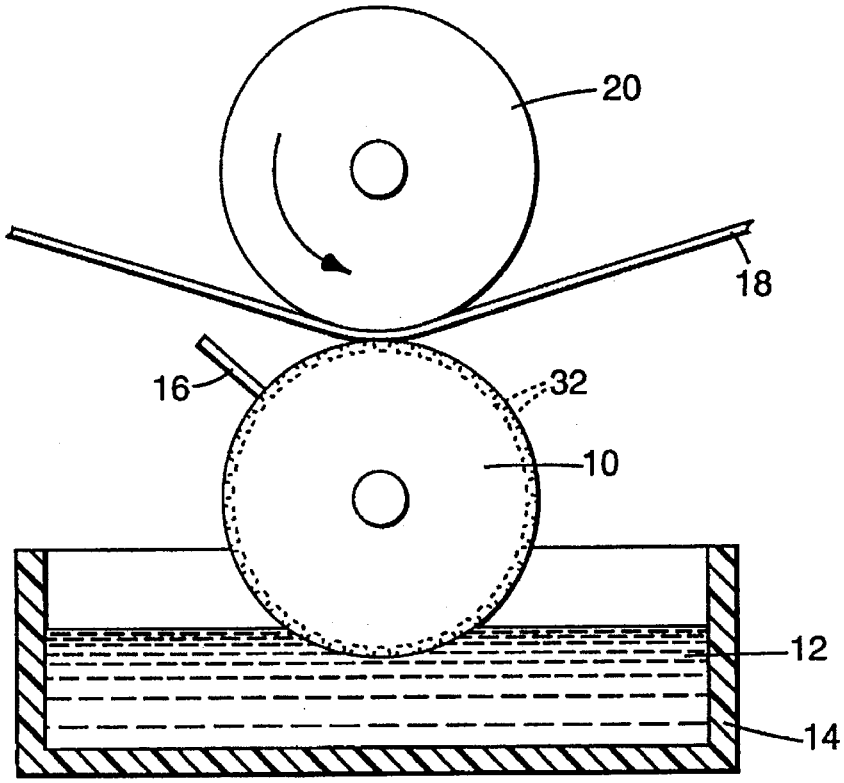
Fig. 1 PRIOR ART
FIG. 1 is a schematic view of a known pan roll coater.
Figure 2:
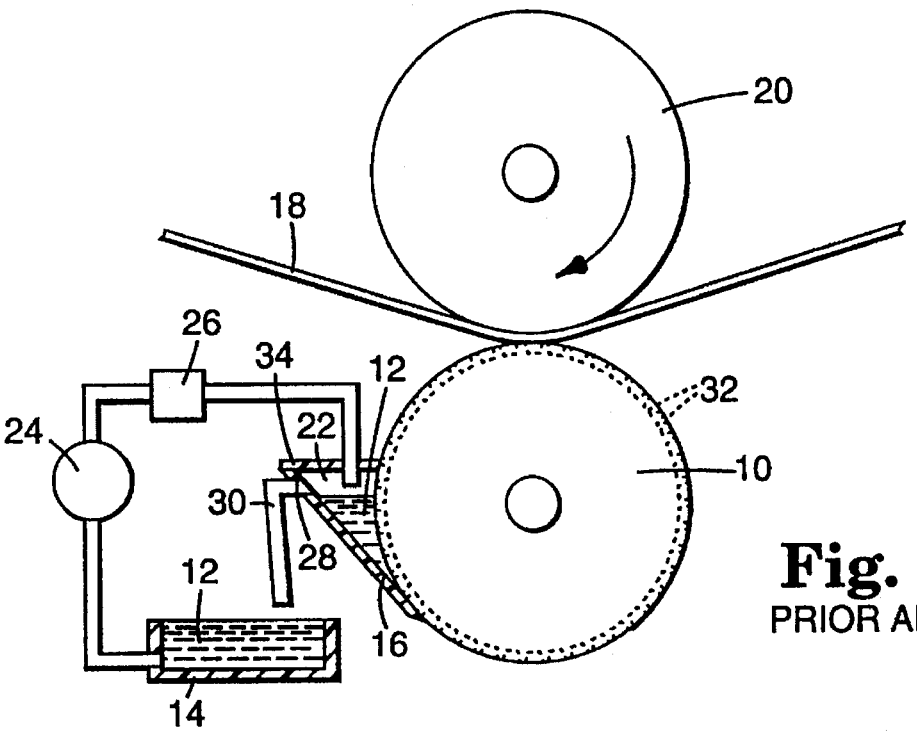
Fig. 2 PRIOR ART
FIG. 2 is a schematic view of a known trough roll coater.
Figure 3:
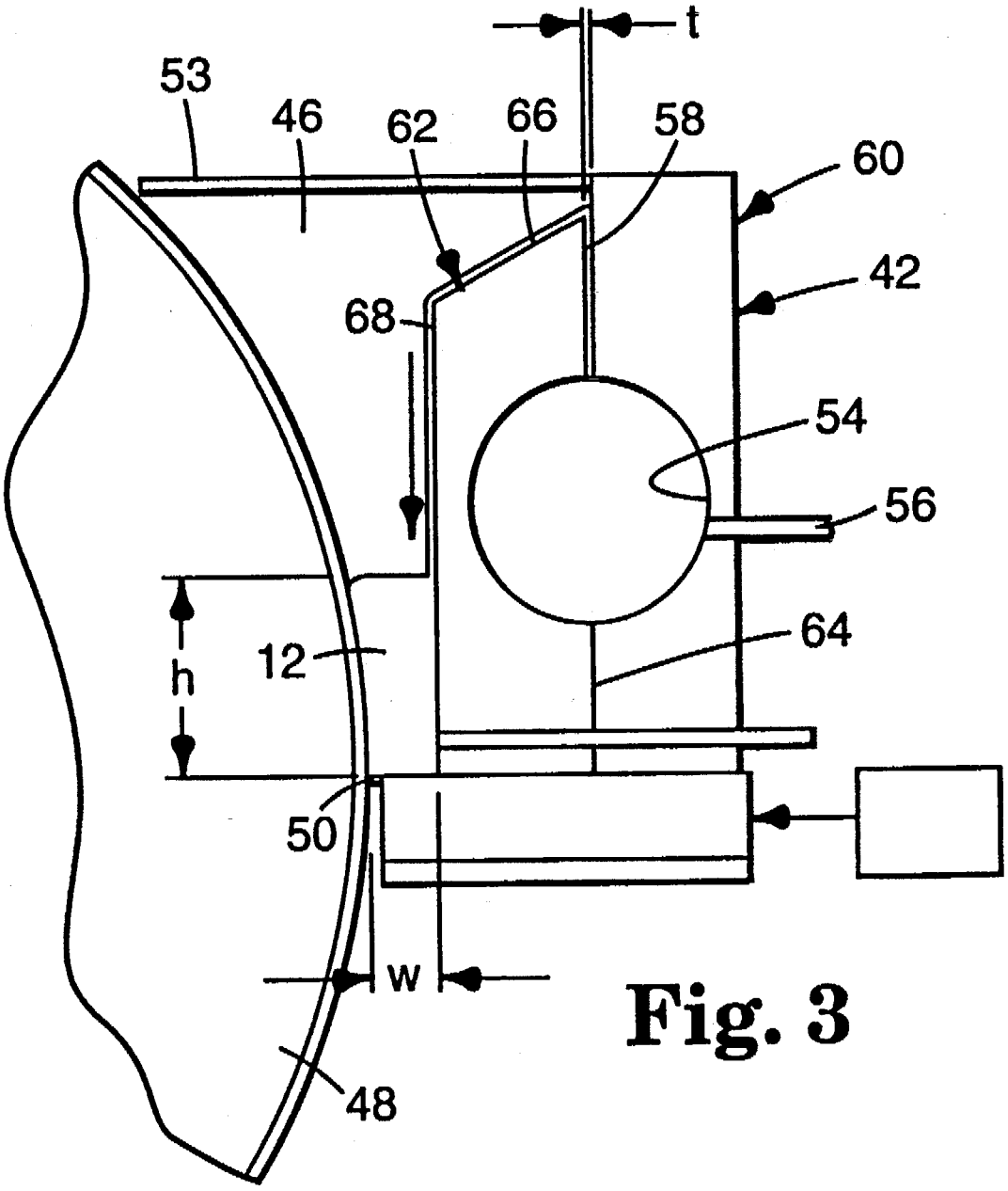
FIG. 3 is a schematic view of the coating system of the present invention.
Figure 8:
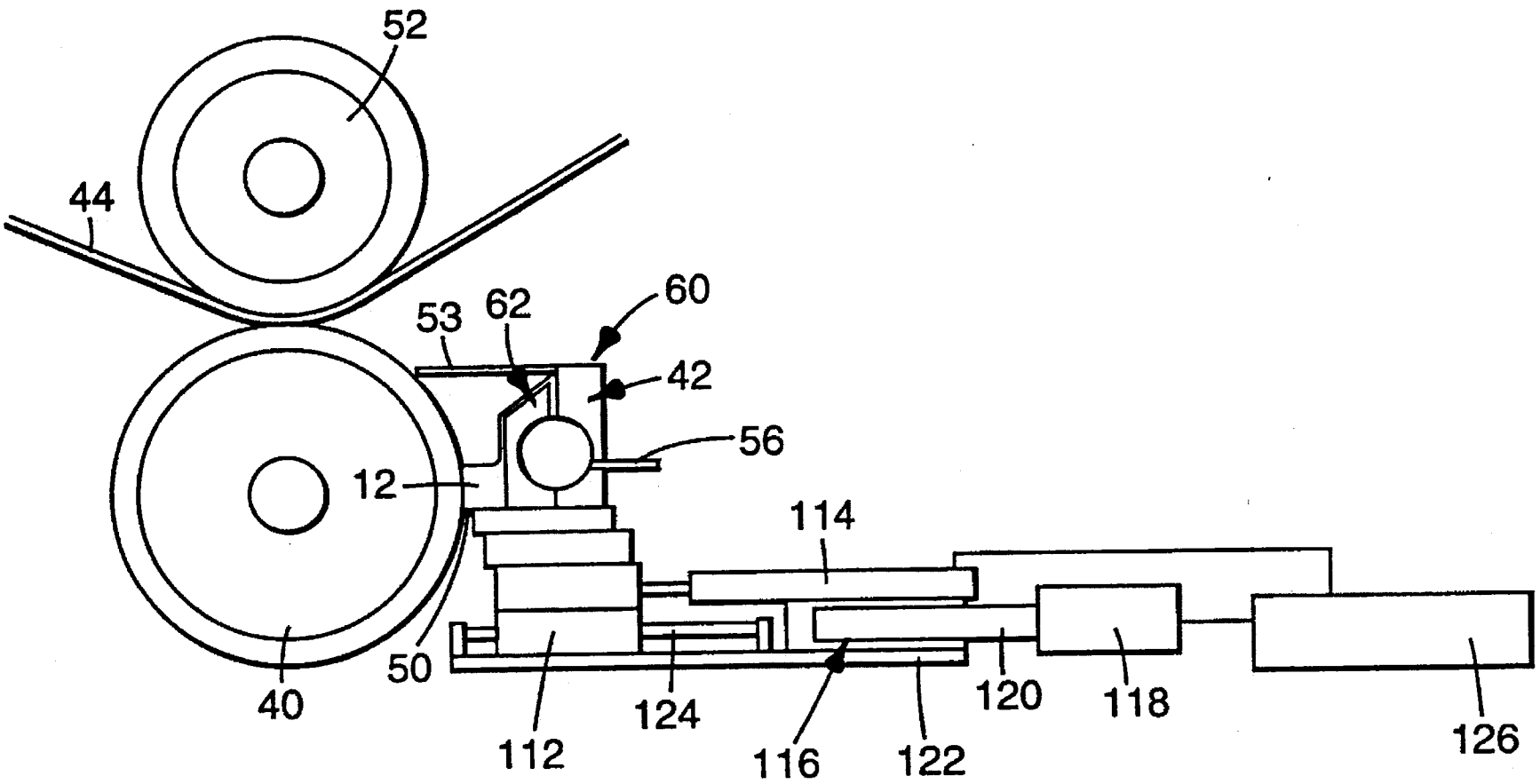
FIG. 8 is a schematic view of the loading system of the present invention.
Figure 9A:
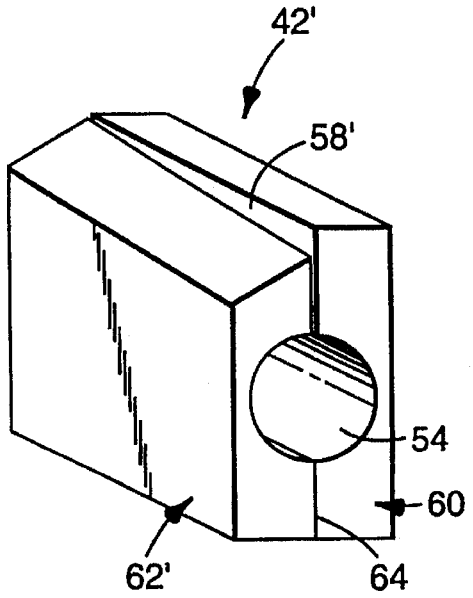
FIGS. 9A, 9B, 9C, and 9D are perspective views of dies according to alternative embodiments of the present invention.
Figure 9B:
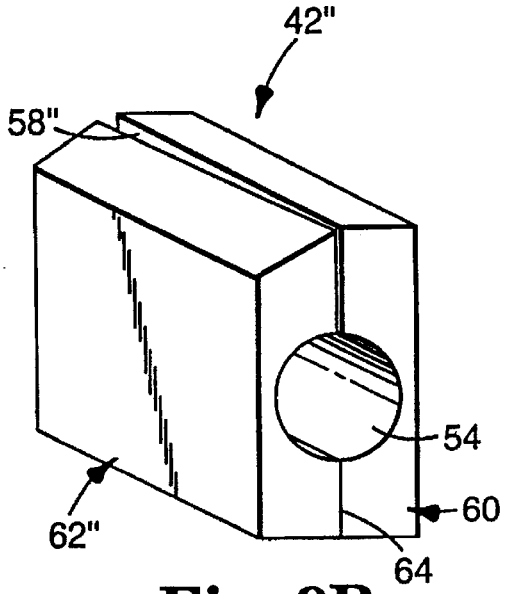
Figure 9C:
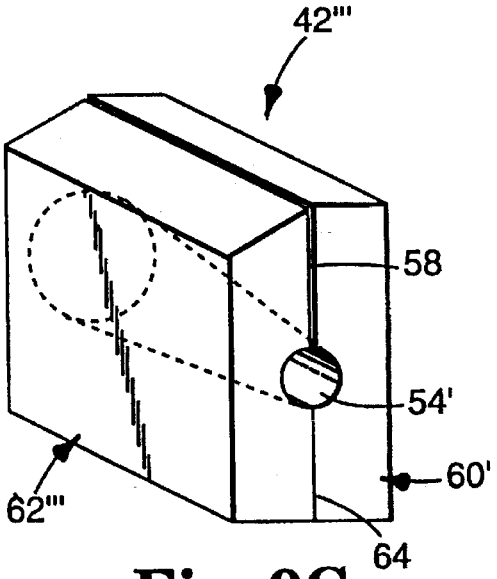
Figure 9D:
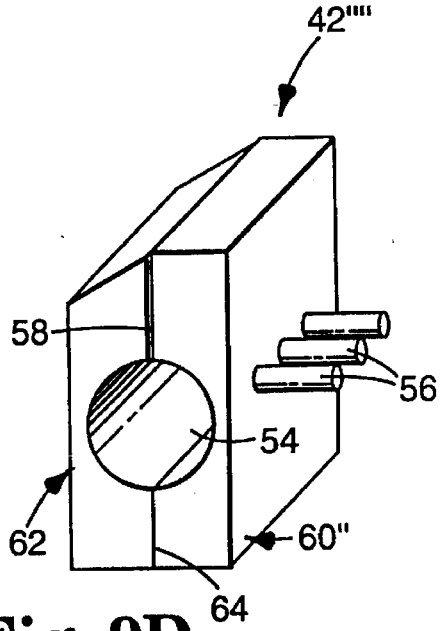

FIGS. 3 and 8 show the coating system of the present invention. Coating fluid 12 is supplied to a die 42 at a rate substantially equal to the rate at which it is applied to a moving substrate such as a web 44. The web 44 can be a flexible film suitable for magnetic recording tape or diskettes. The direction in which the web is transported is the downweb direction and the direction in the plane of the web perpendicular to the downweb direction is the crossweb direction.

Coating fluid 12 is extruded from and flows along one side of the die 42 to a reservoir 46. A reservoir cover 53 mounted on the die 42 limits fluid drying. A receiving roller, shown as a gravure cylinder 48, receives the coating fluid 12 from the bottom of the reservoir 46. A doctor blade 50 extends from a lower wall of the reservoir 46 and can help form all or part of the lower wall. The doctor blade 50 wipes off excess fluid from the surface of the gravure cylinder 48. The coating fluid 12 is coated from the gravure cylinder 48 onto the web 44 which passes around a backup roller 52.

This system is a rotating roller type coater in which the coating fluid is supplied to the rotating roller from a die, rather than from an open pan or trough. The system cleanly and uniformly applies and doctors fluid onto a roller to coat a web without recycling excess fluid. This system can handle a wide range of fluids including inks, adhesives, abrasives, and non-self-cleaning fluids such as magnetic dispersions for magnetic media products.

By combining the feeding and metering steps, the system reduces the number of critical hardware components and process variables required for roll coating. This improves the coating uniformity, reduces waste, and makes it easier to find the source of any coating problems. The system reduces the amount of time and waste produced during equipment start-up. Also, cleaning the critical coating head components can be completed with little effort. Also, this system enables the reduction or elimination of filtering after adding catalysts. This extends the filter life and reduce filtration related costs.

The die 42 is easy to fabricate from readily available materials such as aircraft grade aluminum. The die halves 60, 62 can be held together without stress to avoid warpage by bolting them together at a mating interface 64. The die 42 ends can be enclosed and sealed as explained below. Removable bolts facilitate cleaning. The die 42 includes a die bore or supply chamber 54 which holds coating fluid 12 provided through a supply tube 56. An infinite manifold die can be used in combination with gravity leveling of the reservoir 46 to improve uniformity for high viscosity fluids without the need to recirculate fluid through a chamber.

The coating fluid is fed from the supply chamber 54 through the die slot 58, where it exits and flows in a continuous film over a spillway 66, and then along a side wall 68 of the die 42 to the reservoir 46. The spillway 66 and the side wall 68 need not be separate parts divided by a sharp corner, as shown in FIG. 3. The spillway and the side wall can be merged into a single straight or curved surface. The continuity of the film on the side wall 68 as it merges with the fluid 12 in the reservoir 46 eliminates dynamic wetting effects which might otherwise occur between the fluid in the reservoir and the side wall.

The crossweb length of the die 42 should be slightly greater than the coated width of the web 44. If this length is much greater, stagnant areas of coating fluid could collect in the ends of the reservoir 46, causing coating flaws.

The die slot 58 is the full length of the die to improve slot dimensional uniformity and flow uniformity. For use with magnetic coating fluids, the thickness t of the die slot 58 is approximately 0.051 cm (0.020 in). To compensate for crossweb differences in coating fluid requirements if the fluid tends to be differentially distributed in the pool, the die 42 can be modified. The die slot length and thickness can be varied, the die bore size can be varied, and the die feed locations can be selected to yield a level reservoir and a more uniform coating caliper, as shown in FIGS. 9A, 9B, 9C, and 9D, respectively.

The die slot 58 exit is above the highest level of the reservoir 46 and is vertical to prevent stagnation and drying of the reservoir surface and slot wetting. A vertical die orientation also decreases the system weight, allows air to purge from the die and fluid, and allows the flow to be viewed and the slot cleaned. Alternatively, the side wall 68 can slope downwardly at another angle, and the die slot 58 can be horizontal, or at any intermediate angle, as long as the exit of the die slot 58 is above the fluid level in the reservoir 46, and an open solid surface supports a continuous film of fluid flowing from the die slot 58 to the reservoir 46. This requirement is for fluids that are not self-cleaning and have drying problems.

The top of the reservoir 46 is confined by gravity and the reservoir shape is designed so that the reservoir surface is in constant motion to avoid drying effects. A rectangular reservoir is easy to build and maintain and provides a low fluid velocity area for level sensing. A wider reservoir also works but the reservoir level should be higher to avoid complex pool flows. Larger reservoir widths make level control easier because height changes less with flow rate changes. Lower viscosity fluids work well over a wider range of reservoir heights due to increased gravity leveling flow.

The reservoir fluid level should be kept relatively constant to prevent running with a low reservoir, starving the doctor blade, and forming coating voids. The flow rate of coating fluid to the die 42 and the reservoir 46 level are controlled by sensing the level of fluid in the reservoir 46 adjacent the gravure cylinder 48 using a static pressure sensor.

The sensing tip of the sensor is positioned in a low velocity area, such as just above the doctor blade and flush with the die surface. The sensor is an input to a closed loop control metering system to prevent dynamic pressure effects from causing errors in the reservoir depth reading. A signal representing the fluid level is fed back to a pump controller, which provides feedback to a pump to adjust the rate of pumping to change the level of fluid in the reservoir to bring it toward a predetermined level. Suitable pump controllers are commercially available. The fluid level sensor can be a modified bubble tube type sensor. By bubbling the test gas through a layer of solvent before injecting it into the bubble tube, solvent vapor can be introduced into the gas. This greatly reduces the drying of coating fluid in the region near the bubbles, thereby reducing clump formation and tube clogging. Other sensors also can be used.

Other hydrodynamic features of the present invention are the width w and fluid depth h of the reservoir 46. During coating, since the surface of the gravure cylinder 48 moves downwardly past the reservoir 46, fluid near the gravure cylinder 48 in the reservoir 46 tends to be carried downwardly due to viscous shear effects. As the fluid reaches the doctor blade 50, the portion of the downwardly moving fluid which is not able to continue with the gravure cylinder 48 must turn and flow along the bottom of the reservoir 46 and away from the gravure cylinder 48, thereby creating eddy flow. This flow prevents localized drying and scumming at the edges of the reservoir and prevents clumping.

It is possible for two or more eddies to occur in the reservoir 46, if the fluid depth h is very large in comparison with width w. For a given set of fluid rheological properties and surface speeds, the size and shape of the reservoir can be selected to achieve a minimum of multiple eddying and unstable flow within the reservoir. For example, for many magnetic fluids, a width to height ratio of from 0.6–0.8 is desirable.

Figure 4:
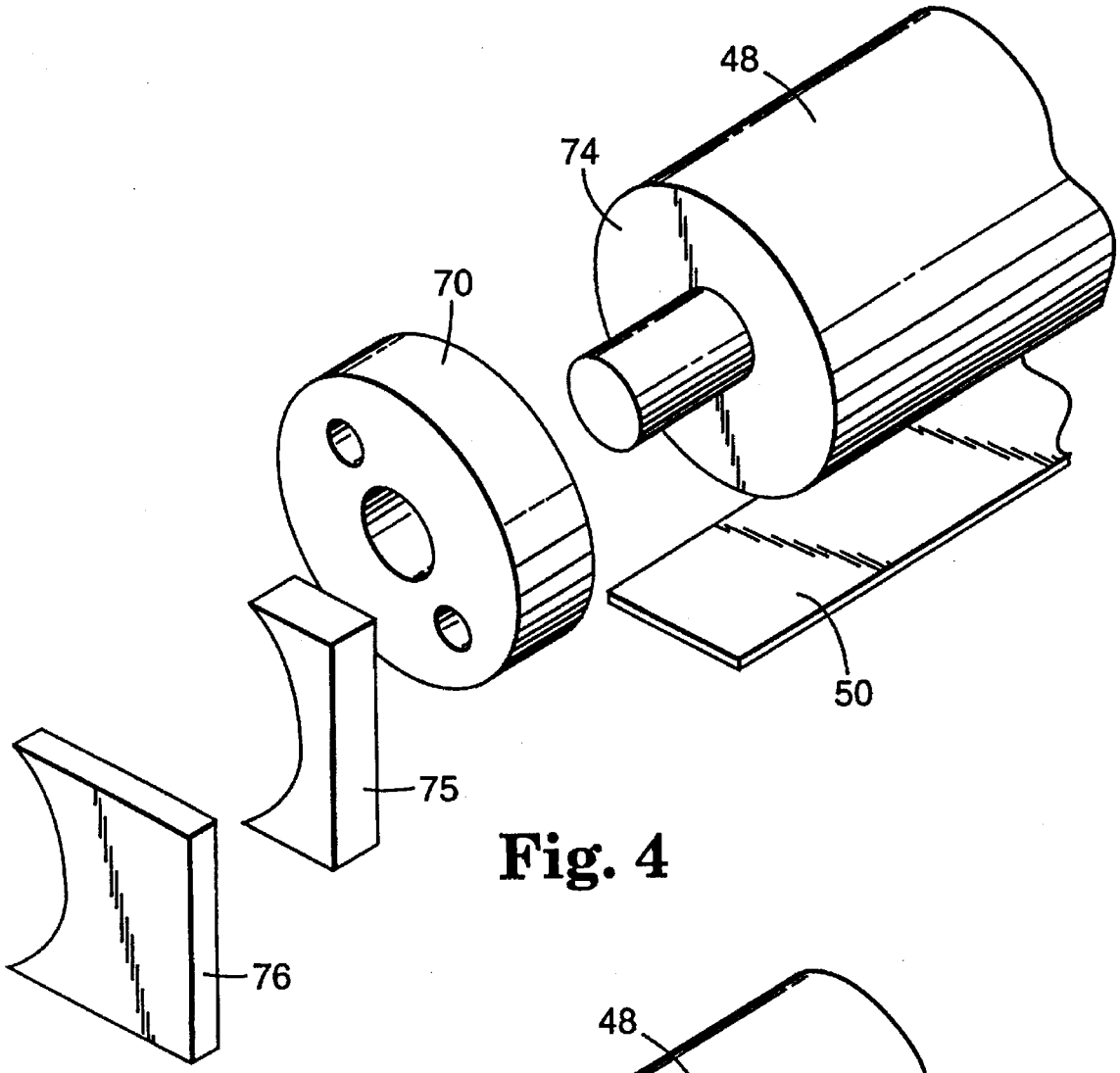
FIG. 4 is an exploded view of the end seals of the present invention.
Figure 5:
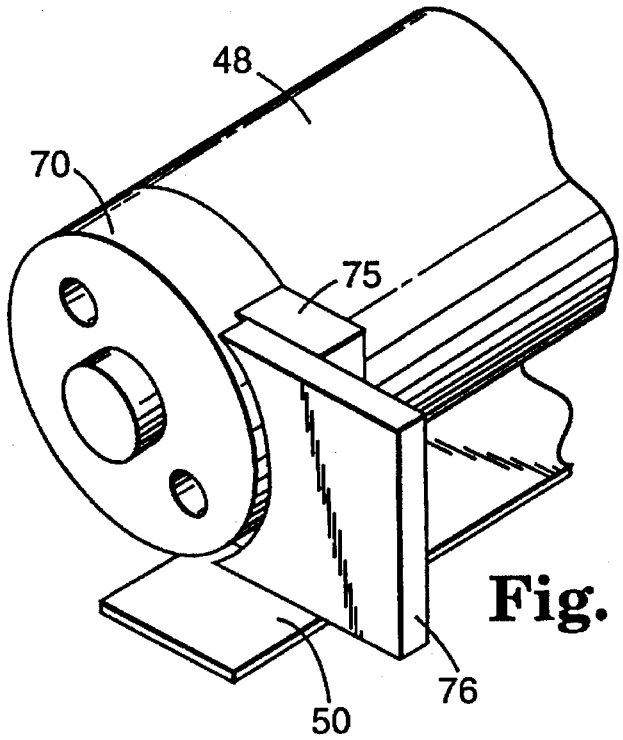
FIG. 5 is an assembled view of the end seals of FIG. 4.

The ends of the reservoir 46 provide a liquid-containing interface with the coating cylinder 48. One end sealing method, as shown in FIGS. 4 and 5, includes a circular or partially circular puck 70 mounted at each end of the gravure cylinder 48. The pucks 70 can be ultra high molecular weight polyethylene, acetal, or nylon and act as stationary cylinder extensions which make the dynamic seal. The pucks 70 are mounted to a frame, which also holds the gravure cylinder 48, via a slide arrangement which allows the pucks to be aligned with the gravure cylinder 48. Alignment can be adjusted independently of die location. Arms, mounted to the slides, contain springs or air cylinders which load the pucks 70 against the end of the gravure cylinder 48.

The ends of the die supply chamber 54 and reservoir 46 can be sealed with foam seals 75 held by end plates 76. The foam seals 75 can be a closed cell polyethylene foam which conforms well to the doctor blade 50, and is chemically inert to commonly used coating fluids. The doctor blade 50 can be longer than the gravure cylinder 48 and penetrate into the foam seals 75 either by placing it in pre-cut foam or by cutting the foam with the doctor blade 50. After the die 42, doctor blade 50, foam seal 75, and end plates 76 are assembled together, the assembly is loaded against the gravure cylinder 48 and the pucks 70. The doctor blade 50, the gravure cylinder 48, and the pucks 70 form the lower seal. As the die assembly is loaded against the pucks, the foam seal is pinched between the doctor blade 50 and the pucks 70 forming a static seal. Alternatively, the end of the die supply chamber 54 can be sealed with an intermediate plate and a gasket or sealant to make this seal independent of the pool seal.

Figure 6:
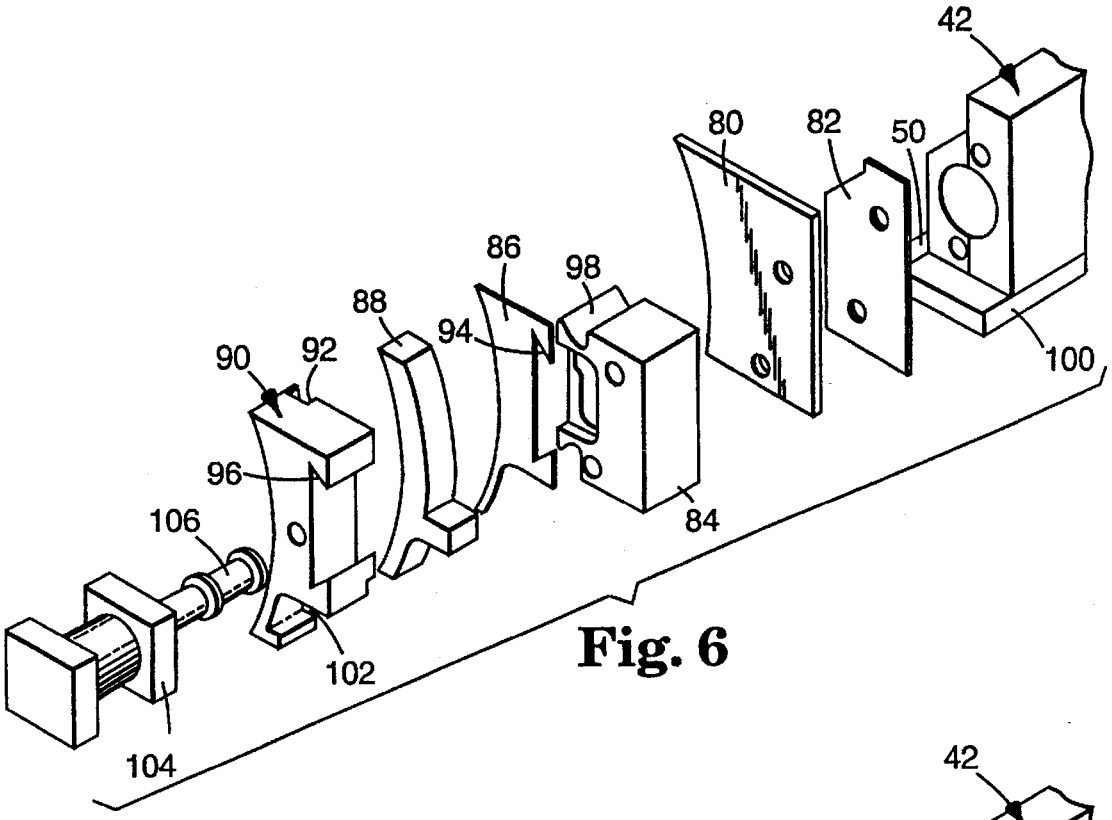
FIG. 6 is an exploded view of the end seals according to another embodiment of the invention.

Another sealing method works best when die mounted. One configuration of this sealing method is shown in FIG. 6. The die supply chamber 54 is sealed with an end plate 80 and a foam seal 82 or a sealant. Shoulder bolts mount and locate a keyhole mounting block 84, the end plate 80, and the foam seal 82 to the die 42. The end plate 80 thickness permits its outer surface to be flush and coplanar with the gravure cylinder end. Alternatively, the end plate-to-end plate length is up to 0.127 cm (0.050 in) and preferably 0.025 cm (0.010 in) shorter than the gravure cylinder length. The doctor blade 50 is clamped between the die body and a die clamp 100. Both the doctor blade 50 and the die clamp 100 are longer than the gravure cylinder 48, preferably by at least 5 cm (2 in).

A thin [0.127–0.025 cm (0.010–0.050 in)] ultra-high molecular weight polyethylene wear plate 86 is slid on the end of the mounting block 84 as shown. The wear plate 86 is configured to seal between the end of the gravure cylinder 48 and the outer surface of the end plate 80. The wear plate 86 barely clears the top and front of the deflected doctor blade 50. A foam pad 88 is inserted in a plastic pad holder 90 and this assembly is slid on the mounting block 84. The wear plate 86 protects the foam pad 88 from the gravure cylinder 48. The foam pad 88 is received in a slot 92 in the pad holder 90, and the wear plate 86 and the pad holder 90 have openings 94, 96 which dovetail onto a complementarily-shaped portion 98 of the mounting block 84. Other shapes and fastening devices also can be used. The pad holder 90 has a pin 102 on which the tail of the foam pad 88 is slid on to pull the foam pad around the deflected doctor blade 50.

An air cylinder 104 with a seal spool 106 loads the foam pad 88 and the wear plate 86 against the end of the gravure cylinder 48 and the end plate 80 of the die assembly. The spool 106 is inserted through the mounting block 84 then is moved down and locked to the die assembly. Then the air cylinder 104 can be loaded to push the pad holder 90, foam pad 88, and wear plate 86 against the gravure cylinder 48 and the die assembly. The foam pad 88 softly holds the wear plate 86 against the end of the gravure cylinder 48 forming the majority of the dynamic seal. The foam pad 88 also fills the gap between the doctor blade 50, the wear plate 86, and the gravure cylinder 46 to complete the seal. A sealant can be used in addition to the foam pad 88 to improve the seal at this triple contact point. This configuration has a very small effect on the measured doctor blade-force read-out.

Figure 7:
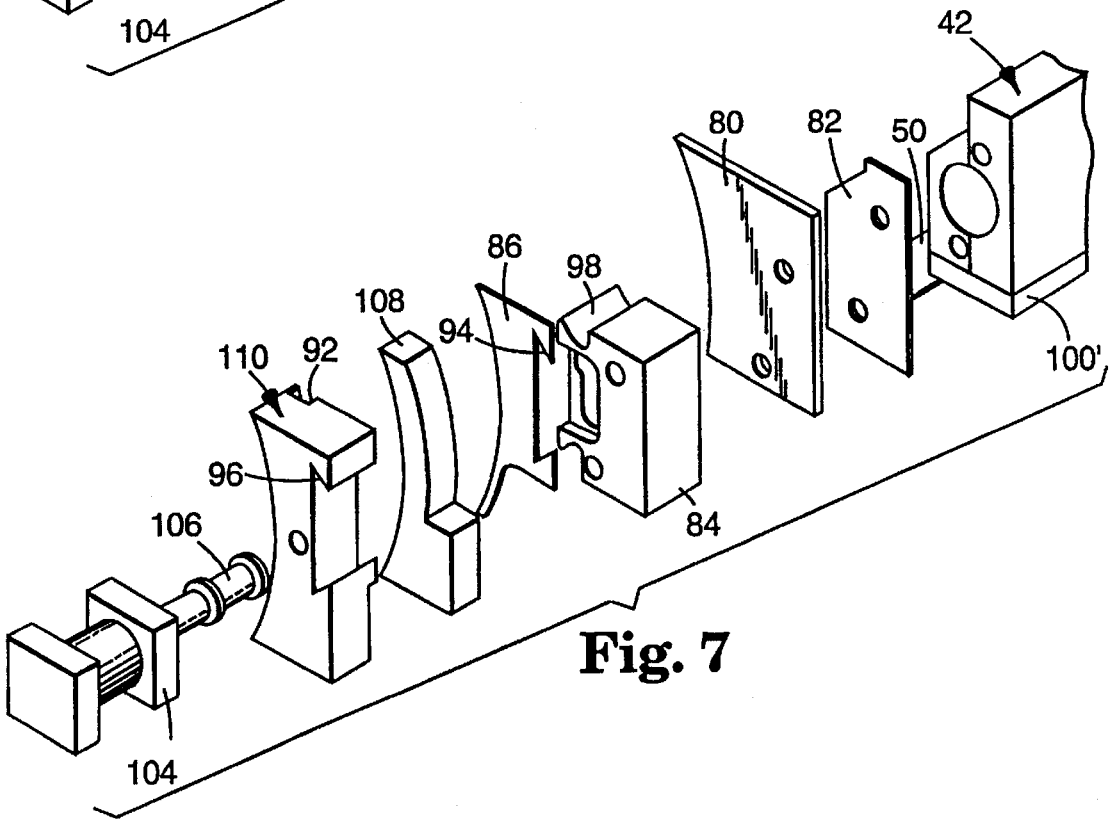
FIG. 7 is an exploded view of the end seals according to another embodiment of the invention.

A similar seal configuration shown in FIG. 7 uses a die clamp 100' that is about as long as the gravure cylinder 48 and a doctor blade 50 that is about 0.32 cm (0.125 in.) longer than the gravure cylinder 48. The foam pad 108 and pad holder 110 are modified so the foam seals against the end of the doctor blade 50 instead of on the top of it. This configuration is very reliable even without using additional sealant. It also has a negligibly small effect on the doctor blade-force read-out.

Separating the reservoir seal from the bore seal enables the seals to be changed without changing the die assembly. Also, the foam seals are shielded and prevented from contacting the gravure cylinder 48. For example, in the embodiment of FIGS. 6 and 7, the foam pad 88 is shielded from and prevented from contacting the gravure cylinder 48 by the plastic wear plate 86.

If the fluid is abrasive, a gravure cylinder end scraper could be used to improve seal life. The scraper can be air loaded.

The doctor blade 50 is pressed against the gravure cylinder 48 by a loading system including a holding device 112. As shown in FIG. 8, the holding device 112 uses a force transducer 114 and a screw slide 116 to press the doctor blade 50 against the gravure cylinder 48 with a predetermined force. The force is sensed by the transducer 114 and a motor 118 rotates the screw 120 of the screw slide 116 to move the slide 122 of the screw slide 116 and thereby to move the die 42 to the desired position. The holding device 112 can include a ball slide 124 on which the die assembly is mounted. Two ball slides 124, one located near each end of the die 42, are typically used to provide equal force at both ends of the doctor blade 50, while the force transducer 114 can be located generally centrally of the die 42. Alternatively, other types of slides can be used.

This loading system is repeatable, accurate, and allows for automatic loading based only on doctoring force using a feedback system 126. Loading can be preset and applied precisely. The system allows rapid replacement of a used die and repeatable die location, and the dies and loading system are inexpensive and easy to assemble and maintain. Using a horizontal slide loading system obtains quantifiable process set-up and enables gravity forces to be ignored, unlike pivoting systems. If a force sensor is located between the loading device and the table then the doctoring force can be directly read without converting air pressure to force or calculating the mechanical advantage of linkage devices. Also, air cylinder drag has no effect on the doctoring force reading as it does with known pivoting air cylinder devices.

During the coating process, when coating must be stopped, it is preferred to maintain the coating system in an idling state to be able to resume coating quickly. It is also preferred to maintain the coating system in an idling state during the start of a coating run, since many adjustments and other tasks must be performed as part of setting up the coating process. However, it is not desirable to completely remove the coating fluid from the coating system, as might be done during cleanup of the apparatus after completion of coating. On the other hand, if the coating apparatus is left idling for more than a few minutes, volatile solvents can evaporate from the reservoir, leading to excessive increases in viscosity and premature solidification of the coating fluid, resulting in increased coating defects. Because even a very small amount of thickening or agglomeration of the coating fluid can produce defects which last for a long time after beginning coating, it is highly desirable to avoid this occurrence. Additionally, it has been found, contrary to conventional belief, that merely adding solvent to the reservoir to make up for that lost by evaporation is insufficient to maintain the desired viscosity of the coating fluid.

Defects due to solvent evaporation during the idling state can be greatly reduced by removing the coating fluid 12 from the reservoir 46 and replacing it with a suitable solvent. It is preferred that the replacement solvent be compatible with the solvent used in the coating fluid, and that it be the same solvent as that used in the coating fluid.

Figure 10:
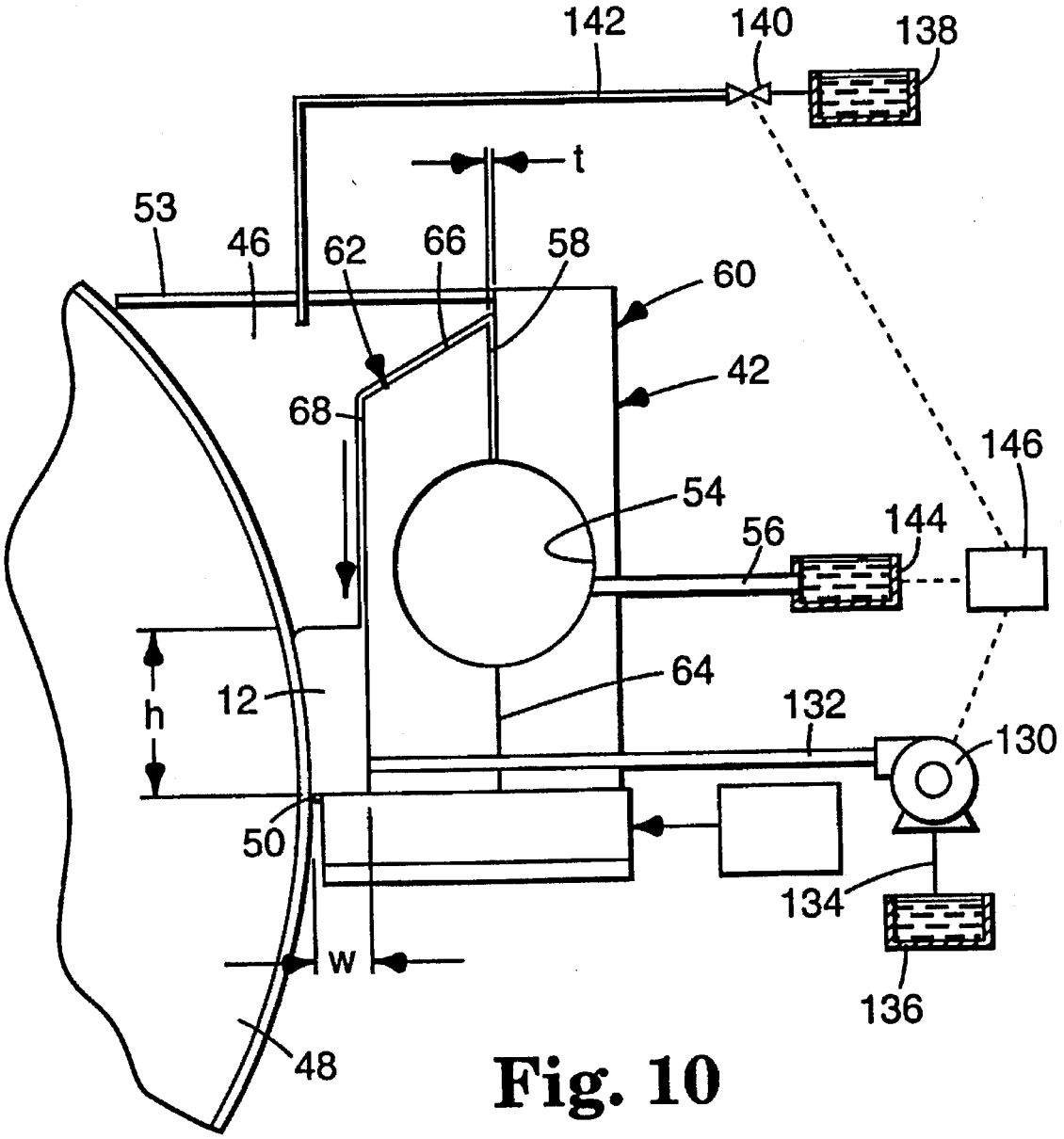
FIG. 10 is a schematic view of the coating system according to another embodiment of the present invention.

FIG. 10 shows one embodiment of the system for replacing the coating fluid with solvent. A pump 130 is connected near the bottom of the reservoir 46 through a tube 132 to enable substantially all of the fluid 12 to be pumped from the reservoir 46. The coating fluid 12 is pumped through a tube 134 to a wet scrap container 136. Replacement solvent is added by any known solvent addition system, such as one including a solvent supply 138, a control valve 140, and a delivery tube 142. The solvent level can be controlled by the level controller (not shown) used in controlling the coating fluid level in the reservoir 46. Sufficient solvent can be added to the reservoir 46 to bring the solvent to a level higher than that used for the coating fluid 12 so the solvent can cover the exit of the die slot 58.

When the coating system is to be placed in the idling state, web transport is stopped, and the gravure cylinder 48 rotation can be either slowed or stopped. When the rotational speed of the gravure cylinder 48 decreases to a predetermined level, the supply of coating fluid 12 from the coating fluid supply 144 to the reservoir 46 is stopped, the pump 130 is activated, and coating fluid 12 is pumped out of the reservoir 46. Immediately thereafter, solvent is added from the solvent supply 138, through the valve 140 and the solvent addition tube 142, to the reservoir 46 until the level predetermined by the level controller is reached. The coating system can idle for several hours without forming agglomerates or other contaminants in the reservoir 46.

Upon resumption of coating, the solvent is pumped from the reservoir 46, the supply of coating fluid 12 from the coating fluid supply 144 is resumed, and the reservoir 46 is filled to the level predetermined by the level controller. Control of the relevant valves, pumps, solvent addition apparatus, and other devices can be accomplished by a known, commercially available, programmable controller 146. Because the sequence of functions involved in the coating fluid and solvent interchange are controlled by the controller 146, the process occurs substantially automatically.

Numerous characteristics, advantages, and embodiments of the invention have been described in detail in the foregoing description with reference to the accompanying drawings. However, the disclosure is illustrative only and the invention is not intended to be limited to the precise embodiments illustrated. Various changes and modifications may be affected therein by one skilled in the art without departing from the scope or spirit of the invention.

We claim:

1. An apparatus for coating an amount of fluid onto a substrate, wherein the fluid uses a solvent, and wherein the apparatus comprises:

a coating die having a coating slot, a supply manifold from which the fluid enters the coating slot, feed openings into the supply manifold, and an external wall along which the fluid flows after exiting through the slot;

a rotatable receiving roller located adjacent the coating die which applies the fluid onto the substrate;

a controlled fluid depth reservoir located between the coating die and the receiving roller which receives the fluid flowing along the coating die which is applied onto the receiving roller;

means for varying the depth of the fluid in the reservoir to compensate for variations in flow rate of coating to the substrate while coating;

a doctor blade for regulating the amount of fluid applied to the receiving roller from the reservoir; and means for compensating for solvent evaporation during idling of the apparatus by removing the fluid from the reservoir and replacing it with a suitable replacement solvent.

2. The apparatus of claim 1 wherein the replacement solvent is compatible with the solvent used in the fluid.

3. The apparatus of claim 2 wherein the replacement solvent is the same solvent as that used in the fluid.

4. An apparatus for coating an amount of fluid onto a substrate comprising:

a coating die having a coating slot having an exit, a supply manifold from which the fluid enters the coating slot, feed openings into the supply manifold, and an external wall along which the fluid flows after exiting through the slot;

a rotatable receiving roller located adjacent the coating die which applies the fluid onto the substrate;

a reservoir having a bottom and located between the coating die and the receiving roller which receives the fluid flowing along the coating die which is applied onto the receiving roller;

a doctor blade for regulating the amount of fluid applied to the receiving roller from the reservoir; and means for compensating for solvent evaporation, if any, during idling of the apparatus by removing the fluid from the reservoir and replacing it with a suitable solvent, wherein the compensating means comprises a pump connected near the bottom of the reservoir to enable substantially all of the fluid to be pumped from the reservoir, and means for adding solvent to the reservoir.

5. The apparatus of claim 4 wherein the adding means comprises a control valve which controls the amount of solvent entering the reservoir, and means for controlling the solvent level in the reservoir, wherein the adding means adds sufficient solvent to the reservoir to bring the solvent to a level higher than that used for the fluid to cover the exit of the die slot.

6. The apparatus of claim 5 further comprising means for controlling the compensating means.

7. The apparatus of claim 6 wherein the controlling means comprises means for sensing when the rotational speed of the receiving roller is less than a predetermined level, means for stopping the supply of fluid to the reservoir, means for activating the pump to pump fluid out of the reservoir, and means for opening the control valve to cause the solvent to be added to the reservoir.

8. An apparatus for coating an amount of fluid onto a substrate comprising:

a coating die having a coating slot, a supply manifold from which the fluid enters the coating slot, feed openings into the supply manifold, and an external wall along which the fluid flows after exiting through the slot;

a rotatable receiving roller located adjacent the coating die which applies the fluid onto the substrate;

a reservoir located between the coating die and the receiving roller which receives the fluid flowing along the coating die which is applied onto the receiving roller;

a doctor blade for regulating the amount of fluid applied to the receiving roller from the reservoir;

means for compensating for solvent evaporation, if any, during idling of the apparatus by removing the fluid from the reservoir and replacing it with a suitable solvent; and means for loading the doctor blade against the receiving roller.

9. The apparatus of claim 8 wherein the loading means can repeatedly apply a force to the doctor blade to locate the doctor blade relative to the receiving roller by moving the doctor blade in only a translational direction without requiring any angled or side-to-side adjustments.

10. An apparatus for coating an amount of fluid onto a substrate comprising:

a coating die having a coating slot, a supply manifold from which the fluid enters the coating slot, feed openings into the supply manifold, and an external wall along which the fluid flows after exiting through the slot;

a rotatable receiving roller located adjacent the coating die which applies the fluid onto the substrate;

a reservoir located between the coating die and the receiving roller which receives the fluid flowing along the coating die which is applied onto the receiving roller;

a doctor blade for regulating the amount of fluid applied to the receiving roller from the reservoir; and means for compensating for solvent evaporation, if any, during idling of the apparatus by removing the fluid from the reservoir and replacing it with a suitable solvent;

wherein the reservoir comprises first and second ends, a front surface formed by the external wall of the coating die, a rear surface formed by the surface of the receiving roller, and a bottom surface formed at least in part by the doctor blade, and wherein the die comprises ends, further comprising first and second end seals which seal the die ends and the ends of the reservoir, wherein the end seals comprise a pad portion which seals against the doctor blade, and a wear plate portion which seals against the receiving roller, wherein the wear plate portion prevents the pad portion from contacting and wearing against the receiving roller.

11. An apparatus for coating an amount of fluid onto a substrate comprising:

a coating die having ends, a coating slot, a supply manifold from which the fluid enters the coating slot, feed openings into the supply manifold, and an external wall along which the fluid flows after exiting through the slot;

a rotatable receiving roller located adjacent the coating die which applies the fluid onto the substrate;

a reservoir located between the coating die and the receiving roller which receives the fluid flowing along the coating die which is applied onto the receiving roller;

a doctor blade for regulating the amount of fluid applied to the receiving roller from the reservoir; and means for compensating for solvent evaporation, if any, during idling of the apparatus by removing the fluid from the reservoir and replacing it with a suitable solvent; and first and second end seals which seal the ends of the die and ends of the reservoir; and means for adjusting the alignment of the end seals;

wherein the reservoir comprises first and second ends, a front surface formed by the external wall of the coating die, a rear surface formed by the surface of the receiving roller, and a bottom surface formed at least in part by the doctor blade.

12. A compensating apparatus which compensates for solvent evaporation during idling of a coating apparatus, wherein the coating apparatus includes a coating die having a coating slot having an exit, a supply manifold from which the coating enters the coating slot, feed openings into the supply manifold, an external wall along which the coating flows after exiting through the slot, a rotatable receiving roller located adjacent the coating die which applies the fluid onto the substrate, a reservoir located between the coating die and the receiving roller which receives the fluid flowing along the coating die which is applied onto the receiving roller, and a doctor blade for regulating the amount of fluid applied to the receiving roller from the reservoir; and wherein the compensating apparatus comprises a pump connected near the bottom of the reservoir to enable substantially all of the fluid to be pumped from the reservoir, and means for adding solvent to the reservoir, wherein the adding means comprises means for controlling the solvent level in the reservoir to add sufficient solvent to the reservoir to bring the solvent to a level higher than that used for the fluid to cover the exit of the die slot.

13. The compensating apparatus of claim 12 further comprising means for sensing when the rotational speed of the receiving roller is less than a predetermined level, means for stopping the supply of fluid to the reservoir, means for activating the pump to pump fluid out of the reservoir, means for causing solvent to be added to the reservoir.

14. An apparatus for coating an amount of fluid onto a substrate comprising:

a coating die having a coating slot, a supply manifold from which the fluid enters the coating slot, feed openings into the supply manifold, and an external wall along which the fluid flows after exiting through the slot;

a rotatable receiving roller located adjacent the coating die which applies the fluid onto the substrate;

a reservoir located between the coating die and the receiving roller which receives the fluid flowing along the coating die which is applied onto the receiving roller; and a doctor blade for regulating the amount of fluid applied to the receiving roller from the reservoir, wherein the cross section of the reservoir is comprised of first and second sides which are adjacent, the first side formed by a side wall of the coating die which is connected to the external wall and the second side formed by the doctor blade, wherein the side wall of the coating die and the doctor blade are substantially perpendicular, and on a third side by the receiving roller.

15. The apparatus of claim 14 wherein the external wall of the coating die comprises a spillway adjacent the coating slot opening.

16. The apparatus of claim 14 wherein the receiving roller is a gravure cylinder.

17. The apparatus of claim 14 wherein the die coating slot has a length that varies to compensate for crossweb differences in coating fluid requirements to produce a level reservoir and a more uniform coating caliper.

18. The apparatus of claim 14 wherein the die coating slot has a length corresponding to the coating width that varies to compensate for crossweb differences in coating fluid requirements to produce a level reservoir and a more uniform coating caliper.

19. The apparatus of claim 14 wherein a size of the supply manifold at the inlet of the die slot varies to compensate for crossweb differences in coating fluid requirements to produce a level reservoir and a more uniform coating caliper.

20. The apparatus of claim 14 wherein the die feed openings into the supply manifold are located to compensate for crossweb differences in coating fluid requirements to produce a level reservoir and a more uniform coating caliper.

21. The apparatus of claim 14 further comprising means for loading the doctor blade against the receiving roller.

22. The apparatus of claim 21 wherein the loading means can repeatedly apply a force to the doctor blade to locate the doctor blade relative to the receiving roller by moving the doctor blade in only a translational, horizontal direction without requiring any angled or side-to-side adjustments.

23. The apparatus of claim 14 wherein the reservoir further comprises first and second ends, wherein the second side provides a bottom surface for the reservoir, the third side provides a rear surface of the reservoir and the first side provides a front surface of the reservoir, and wherein the die comprises ends, further comprising first and second end seals which seal the ends of the die and the ends of the reservoir, wherein each end seal comprises a pad portion which seals against the doctor blade, a non-rotating wear plate portion mounted coaxially with the receiving roller and which seals against the end of the receiving roller, means for urging the wear plate portion into contact with the receiving roller, and an end plate, wherein each pad portion contacts a wear plate portion, the front surface of the reservoir, the doctor blade, and the end plate, and wherein the wear plate portion prevents the pad portion from contacting and wearing against the receiving roller.

24. The apparatus of claim 23 further comprising an end plate mounted on the end of the die between the die and the wear plate portion, wherein the end plate supports the wear plate portion.

25. The apparatus of claim 23 further comprising means for end loading the end seals to maintain the end seals in position adjacent the ends of the die to compensate for relaxation of the seals over time.

26. The apparatus of claim 14 wherein the reservoir further comprises first and second ends, wherein the second side provides a bottom surface for the reservoir, the third side provides a rear surface of the reservoir and the first side provides a front surface of the reservoir, and wherein the die comprises ends, further comprising first and second end seals which seal the ends of the die and the ends of the reservoir and means for adjusting the alignment of the end seals independent of the location of the die.

27. The apparatus of claim 14 wherein the fluid in the reservoir has a depth and further comprising means for measuring the depth of the fluid in the reservoir and means for controlling the depth of the fluid in the reservoir.

28. The apparatus of claim 14 wherein the coating slot has an exit that is above the sidewall of the coating die.

29. The apparatus of claim 14 wherein the reservoir creates a static wetting line of coating fluid.

* * * * *